US005355565A

United States Patent [19]

Baravian

[11] Patent Number: 5,355,565

[45] Date of Patent: Oct. 18, 1994

[54] PROCESS FOR THE PRODUCTION OF A NON-WOVEN CLOTH CONSTITUTED OF CONTINUOUS INTERCONNECTED FILAMENTS AND CLOTH THUS OBTAINED

[75] Inventor: Jean Baravian, Sundhoffen, France

[73] Assignee: Freudenberg Spunweb S.A., Colmar, France

[21] Appl. No.: 53,367

[22] Filed: Apr. 28, 1993

[30] Foreign Application Priority Data

Apr. 22, 1993 [FR] France ..... 93 04919

[51] Int. Cl.[5] ..... D04H 1/42; D04H 1/46

[52] U.S. Cl. ..... 28/104; 28/105; 19/163; 264/171

[58] Field of Search ..... 28/104, 105; 19/163; 264/171

[56] References Cited

U.S. PATENT DOCUMENTS

| | | | |
|---|---|---|---|
| 4,017,580 | 4/1977 | Barbey | 19/163 X |
| 4,188,690 | 2/1980 | Suzuki et al. | 28/104 X |
| 4,329,763 | 5/1982 | Aiexander et al. | 28/104 |
| 4,548,628 | 10/1985 | Miyake et al. | 28/104 X |
| 4,560,385 | 12/1985 | Baravian | 264/171 X |
| 4,939,016 | 7/1990 | Radwanski et al. | 28/104 X |

FOREIGN PATENT DOCUMENTS

| | | |
|---|---|---|
| 0098603 | 1/1984 | European Pat. Off. . |
| 0147904 | 7/1985 | European Pat. Off. . |
| 0148033 | 7/1985 | European Pat. Off. . |
| 4-034058 | 2/1992 | Japan . |
| 4-057950 | 2/1992 | Japan . |
| 4-065567 | 3/1992 | Japan . |
| 1088376 | 10/1967 | United Kingdom . |

*Primary Examiner*—Clifford D. Crowder
*Assistant Examiner*—John J. Calvert
*Attorney, Agent, or Firm*—Young & Thompson

[57] ABSTRACT

A process for the production of a non-woven sheet of continuous interconnected filaments, comprising producing biconstituted filaments of a size less than 4 dtex comprising two interconnected elemental filament components each of a different polymer, imparting to the biconstituted filaments a curl having a curling frequency of 3 to 30 curls per centimeter to impart to the filaments a bunching upon curling of 50 to 400%, and forming a non-woven sheet from the curled biconstituted filaments, the sheet having a weight of 10 to 400 g/m$^2$. The non-woven sheet is then subjected to water jets supplied under a pressure of 50 to $300\times10^5$ Pa to interlace and entangle the curled filaments constituting the sheet and to separate the interconnected filaments from each other.

8 Claims, 1 Drawing Sheet

Figure 1:
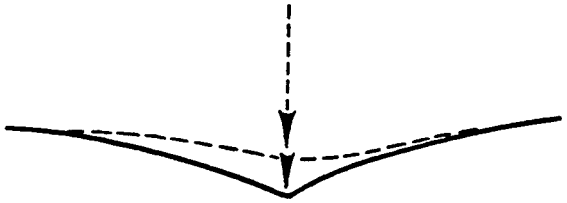

PROCESS FOR THE PRODUCTION OF A NON-WOVEN CLOTH CONSTITUTED OF CONTINUOUS INTERCONNECTED FILAMENTS AND CLOTH THUS OBTAINED

The present invention relates to the field of the production of non-woven sheets or webs, of continuous filaments obtained by melt spinning polymers, and has for its object a process for the production of a non-woven sheet constituted of continuous interconnected filaments, as well as a sheet thus obtained.

Among the known techniques for connecting filaments, there exist particularly the connection by jets of fluid such as jets of air, steam, various aqueous solutions or even jets of water under high pressure.

The present connection processes consist in treating by fluid jets, particularly a jet of water under high pressure, the non-woven material obtained by techniques such as the wet method or the dry method (by mechanical or pneumatic carding of fibers 20 to 80 mm long).

The wet technique uses short flat fibers, of a length rarely exceeding 20 mm.

The dry technique, as such, uses fibers generally curled, which greatly facilitates the production of single piece voile, whose length can be up to 80 mm.

The two processes for the production of non-woven sheets most often use mixtures of synthetic fibers, with if desired the addition of artificial or natural fibers. The natural or artificial fibers, often of cellulosic origin, permit, by their presence, better production of the connection by water jets under pressure because of their sensitivity to this element.

Moreover, the high mobility of the cut fibers, displaced under the action of the jets, permits a rearrangement of the structure by sliding of all or a portion of the fibers in the direction of the lines of force exerted perpendicularly to the plane of the sheet.

But these treatment processes of the non-woven material by fluid jets, when said non-woven materials are formed of continuous and straight filaments of synthetic polymer, operate with great difficulty, because of the continuity itself of the filaments which brake their mobility, render their entangling very poor and require very high jet pressures, greater than $200\times10^5$ Pa for a mediocre binding effect, namely a non-woven sheet not having improved characteristics or supplemental advantageous properties relative to non-woven sheets of traditional continuous filaments.

The present invention has particularly for its object to overcome these drawbacks.

It thus has for its object a process for the production of a non-woven sheet constituted of continuous interconnected filaments, characterized in that it consists in producing a non-woven sheet from biconstituted filaments having a curl, then subjecting said sheet to jets of fluid under high pressure, whose mechanical action effects an entanglement and an interlacing of the curled filaments constituting said sheet.

Figure 2:
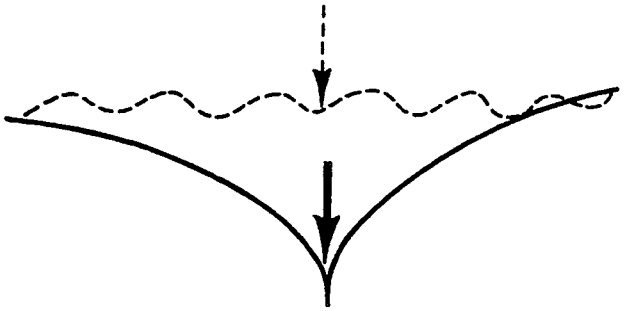

The invention will be better understood from the following description, which relates to a preferred embodiment, given by way of non-limiting example, and explained with reference to the schematic drawing, in which:

FIG. 1 shows schematically the deformation of a flat filament under the action of a fluid jet according to known procedures, and FIG. 2 shows schematically the deformation of a curled filament under the action of a jet of fluid according to the process of the invention.

According to the invention, the production process consists first of all in making a non-woven sheet from biconstituted filaments having a curl, then submitting said sheet to jets of fluid under high pressure, whose mechanical action effects an entangling and an interlacing of the curled filaments constituting said sheet.

As shown in FIGS. 1 and 2 of the accompanying drawing, the maximum deformation of a filamentary element comprised of a curled filament (FIG. 2) is substantially greater than that of a filamentary element composed by a straight filament, flat or straight (FIG. 1), for elements having identical distances between their ends.

Moreover, the force necessary for the displacement or deformation of such a curled filament is less than that necessary for a straight filament, for a similar result.

Moreover, the effect of the jet of fluid on the curled elements is substantially more efficacious than on straight filaments.

As a result, the intensity of entanglement or interlacing of the continuous biconstituted curled filaments, and hence the quality and the solidity of the connection between said curled filaments of non-woven sheet, are very greatly superior to those obtained by continuous straight or rectilinear filaments, for an identical quantity of energy consumed in the course of connection.

According to a first characteristic of the invention, the biconstituted and curled filaments constituting the non-woven sheet, have a two-layer structure comprising two elementary filament components consisting of two different polymers.

The production of a non-woven sheet composed of continuous curled filaments, with a two-layer structure can particularly be carried out according to the process described in U.S. Pat. No. 4,560,385, producing spontaneous, intense and stable curling because of the asymmetric nature of the filaments during their cooling by air or in the course of their drawing.

The biconstituted filaments comprising two filamentary components side by side, are preferably composed of two different polymers, in the form particularly of a combination, on the one hand, of a polyamide selected from the group consisting of polyamide 66, polyamide 6 and polyamide 11, and, on the other hand, of a polyester selected from the group consisting of polyethylene terephthalate, polybutylene terephthalate and copolyesters thereof.

However, the polyester-polypropylene couples, the polyamide-polypropylene couples, the couples of two different types of polyamides or the couples of the different polyesters, such as ethylene polyterephthalate and polybutylene terephthalate, are also very suitable for obtaining two-layer structures leading to spontaneous curling.

The proportions of the two polymers constituting the two-layer filament, can vary in proportion from 95/5 to 5/95. The proportions relative to each other of the constituents influence moreover the quality and intensity of curling. The adjustment of this proportion of one and the other constituent is one of the means of controlling the curling of the filaments.

These filaments can be obtained by various known processes for spinning/extrusion and can have, in addition to a circular cross section, various sections such as for example trilobate, quadrangular, or even lenticular or other shapes.

For the different shapes of filaments, it is each time essential to make use simultaneously both of asymmetry and the differentiation of the physical form of the two elementary components during the phases of cooling and drawing of the biconstituted filament, so as to obtain curling.

This latter may, as the case may be, be increased by supplemental chemical treatments, such as those described in the above-mentioned application or physical treatments such as a thermal treatment leading to differential shrinkage in each polymer.

According to a preferred embodiment of the invention, the process can preferably consist, in the case of elementary filament components of incompatible polymers, in subjecting, by means of fluid jets, the filaments of the nonwoven sheet to a mechanical action whose intensity is such that said filaments are disassociated as to their elementary filament components, these latter being then interlaced and entangled under the influence of said fluid jets.

In the case, for example, of a two-layer filament of a component of polyethylene terephthalate and a component of polyhexamethylene adipamide, the complete separation or disassociation of said filament is effected under the action of water jets under very high pressure and thereby permitting obtaining, for example, from a biconstituted filament of 2 dtex, two separate filaments of 1 dtex.

This reduction of the standard size of the filaments also gives rise to a better reaction of the fibrous network under the mechanical action of the water jets, improving entanglement.

Preferably, the size standard of the biconstituted filaments used is less than 4 dtex, said filaments comprising a frequency of curling of 3 to 30 curls per centimeter, preferably 8 to 20 curls per centimeter and a bunching because of curling, of 50 to 400%.

The term curl designates in the present text the undulation in the space of a filament or thread and can be defined numerically by the values of the frequency of curling, designating the number of curls per unit length of thread or of filament, and of the degree of curling indicating, in percentage, the difference between the uncutled length and the curled length of the thread or filament relative to the uncurled length of this latter.

Moreover, the non-woven sheet produced by means of biconstituted and curled filaments has a weight of 10 to 400 g/m$^2$, preferably 20 to 200 g/m$^2$.

According to another characteristic of the invention, the fluid jets consist of water jets applied under a pressure of 50 to $300\times10^5$ Pa, preferably $100\times10^5$ to $250\times10^5$ Pa, said jets being preferably applied on both surfaces of the non-woven sheet.

The nozzles for the generation of the fluid jets should preferably have an ejection outlet opening diameter comprised between 100 $\mu$m and 250 $\mu$m, said nozzles being arranged on rods, disposed in one or two rows, with a spacing between ejection orifices preferably comprised between 0.2 and 1.2 mm.

The webs supporting the non-woven material, during the binding treatment, are constituted of metallic wire or synthetic material and their type of structure and the closeness of the meshes determine the appearance of the non-woven material after treatment, as well as the size and spacing of the nozzles.

There is thus obtained either open work products with a predetermined pattern and a large mesh, or products with a meshed or flanneled appearance and a fine mesh.

In this latter case, the surfaces supporting the non-woven sheet during application of the fluid jets consist of tight metal sheets of 80 to 100 mesh.

The possibilities of speed of operation depend on the size of the filaments, their Young's modulus, their sensitivity to water, the weight per square meter of the non-woven material, and of course the energy available per unit surface, and finally on the desired degree of binding. This speed can be between 10 and 100 meters per minute or more, for very thin sheets.

The invention also has for its object a non-woven sheet, obtained by means of the process described above, and composed either of continuous biconstituted filaments having a curl, said sheet having a connected structure resulting from an intense entanglement and interlacing of said filaments, or continuous curled entangled and interlaced filaments, consisting of two different materials and obtained by dissociation of two component continuous filaments of two-layer structure.

The sheets thus treated have, on the one hand, properties of non-woven materials from continuous filaments, such that the levels of resistance to breaking, tearing and puncturing are very high, but also, on the other hand, the flexibility, the drape, the opacity and the so-called "lint-free property", that is not having free fibers or fibrils, which is a considerable advantage in medical and surgical uses such as wound dressings, operating rooms, medical blouses or the like, and permit obtaining a high resistance to scuffing and kitchen cleaning. These properties can be even more improved by conventional finishing operations of the textile industry.

Similarly, there could be preferably carried out as needed, textile improvement treatments such as dyeing, printing by transfer methods, pigment or fixed bath printing, toughening or abrading treatments or the like.

In addition to the medical applications mentioned, the use of sheets thus obtained can also extend to other textile fields such as furnishings (tapestries, wall coverings, clothing having conventional flannelized or felted appearance, upholstery, covers, etc. . . ), supports for coatings (shoes, artificial leather, baggage, interior automobile trim, etc. . . ) or also synthetic suede leathers or coatings obtained by impregnation with flexible binders or for example cured-polyurethane.

The present invention will be illustrated by the following example.

There is produced, by the process of the apparatus which is the object of the document FR 74 20254, a non-woven sheet weighing 110 g/m$^2$ under the following conditions:

extrusion of filaments of 1.5 dtex, each constituted by two filamentary components, one of polyester (ethylene glycol polyterephthalate) and the other of polyamide (polyhexamethylene adipamide) in side-by-side relation and in 50/50 proportion by volume;

drawing in a pneumatic nozzle with an air pressure of $3.2\times10^5$ Pa, located 125 cm from the spinneret;

deposit of the filaments on an endless receiving surface by using the so-called "travelling" process described in FR 74 20254.

The 110 g/m$^2$ sheet thus obtained constituted of bicomponent filaments and whose spontaneous curling, manifested upon reception on the receiving surface, is 16 curls/cm, is then transported at a speed of 12 meters per minute to an apparatus for binding by water jet provided with a metallic transport cloth of 100 mesh with 25% openings.

The bonding apparatus permits treating successively the non-woven material on one surface, then the other, by means of two assemblies of two rows (bars) of jets spaced apart from each other 0.6 mm. The openings of the nozzles have a diameter of 100 μm and the pressures of the water jets of each of the rows are successively 160-220-140-140$\times 10^5$ Pa for the first assembly and on one surface, the same being true for the second assembly situated on the other surface of the sheet.

The sheet, after draining, is dried on a drum with through air flow, at a temperature of 160° C.

It has been noted that the subjection of the sheet, during the operation of drawing, to a hot and humid ambient, has generally an action of accentuating the curl of the filaments in the midst of the non-woven material, particularly if these have been imperfectly separated into unitary constituents by the action of the jets of water under pressure. This has the tendency to cause the sheet to shrink by consolidating the bonding and giving improved properties of "drape" to the non-woven material.

The sheet obtained has a very soft feel and is very flexible.

It has been determined by microscopic examination that the strands of polyamide and polyester are completely separated and that the entanglement is accomplished to a very advanced stage.

The rupture load as well as the rupture energy of the sheet, measured according to the AFNOR GO7001 standard, the resistance to sudden tearing, measured according to the AFNOR GO7055 standard and the resistance to bursting, according to the standard AFNOR GO7112, are at a very high level; the resistance to flexure is measured according to recommendation ISO/TC.94/SC 1139 F 3/70.

The deformation under load is also very limited, which completely demonstrates the very good level of bonding.

The following table shows the different characteristics, on the one hand, of a non-woven sheet (A) constituted of continuous and curled filaments of a bilaminar polyamide 6.6/polyethylene terephthalate (50/50) structure of 1.5 dtex connected by water jets under pressure according to the process described above, and, on the other hand, of a non-woven sheet (B) constituted of single layer filaments, continuous and not curled, of 1.5 dtex, and comprised by polyethylene terephthalate polyester.

The comparison of the two columns of figures permits appreciating the outstanding advantages obtained by the invention.

| | | | (A) | (B) |
|---|---|---|---|---|
| Surface mass | | ($g/m^2$) | 108.5 | 110 |
| | SL | (daN) | 43.7 | 32.3 |

-continued

| | | | (A) | (B) |
|---|---|---|---|---|
| Rupture load | ST | (dAN) | 26.4 | 22.1 |
| Isotropy | | (%) | 1.65 | 1.46 |
| Elongation | SL | (%) | 84.2 | 72.3 |
| Elongation | ST | (%) | 88.5 | 75.6 |
| Elongation/3 daN | SL | (%) | 4.4 | 8.2 |
| Elongation/5 daN | SL | (%) | 7.3 | 15.6 |
| Elongation/10 daN | SL | (%) | 15.3 | 26.5 |
| Elongation/3 daN | ST | (%) | 14.2 | 23.6 |
| Elongation/5 daN | ST | (%) | 21.5 | 36.8 |
| Elongation/10 daN | ST | (%) | 36.3 | 51.5 |
| Bursting energy | SL | (j) | 42.1 | 21.3 |
| Bursting energy | ST | (j) | 22.9 | 13.6 |
| Thickness | | (mm) | 0.66 | 1.17 |
| Thermal contraction | SL | (%) | 0.9 | 0.8 |
| Thermal contraction | ST | (%) | 0.8 | 0.7 |
| Flexure | SL | (mg/cm) | 846 | 1025 |
| Flexure | ST | (mg/cm) | 221 | 348 |

Of course, the invention is not limited to the embodiment described and shown in the accompanying drawing. Modifications remain possible, particularly as to the construction of the various elements or by substitution of technical equivalents, without thereby departing from the scope of protection of the invention.

I claim:

1. A process for the production of a non-woven sheet of continuous interconnected filaments, comprising producing biconstituted filaments of a size less than 4 dtex said biconstituted filaments comprising two interconnected elemental filament components each of a different polymer, imparting to said biconstituted filaments a differential shrinkage resulting in a curling frequency of 3 to 30 curls per centimeter which in turn produces a bunching of the filaments of 50 to 400%, forming a non-woven sheet from said curled biconstituted filaments, the sheet having a weight of 10 to 400 $g/m^2$, and subjecting the non-woven sheet to water jets supplied under a pressure of 50 to 300$\times 10^5$ Pa to interlace and entangle the curled filaments constituting said sheet and to separate said interconnected filaments from each other.

2. A process according to claim 1, wherein one of said components is a polyamide selected from the group consisting of polyamide 66, polyamide 6 and polyamide 11, and the other of said components is a polyester selected from the group consisting of polyethylene terephthalate, polybutylene terephthalate and copolyesters thereof.

3. A process according to claim 1, wherein said filaments have 8 to 20 curls per centimeter.

4. A process according to claim 1, wherein said non-woven sheet has a weight of 20 to 200 $g/m^2$.

5. A process according to claim 1, wherein said pressure is 100 to 250$\times 10^5$ Pa.

6. A process according to claim 1, and applying said water jets sequentially to both surfaces of the non-woven sheet.

7. A process according to claim 1, and thereafter drying said sheet in a hot and humid ambient to accentuate the curling of the filaments and to give rise to a shrinkage and consolidation of said sheet.

8. A non-woven sheet produced by the process of claim 1.

* * * * *